US008336643B2

(12) United States Patent
Harleman

(10) Patent No.: US 8,336,643 B2
(45) Date of Patent: Dec. 25, 2012

(54) VIBRATORY DRILLING APPARATUS

(76) Inventor: Ronald Harleman, Appleton City, MO (US)

( * ) Notice: Subject to any disclaimer, the term of this patent is extended or adjusted under 35 U.S.C. 154(b) by 295 days.

(21) Appl. No.: 12/855,922

(22) Filed: Aug. 13, 2010

(65) Prior Publication Data

US 2012/0037424 A1 Feb. 16, 2012

(51) Int. Cl.
*E21B 7/24* (2006.01)

(52) U.S. Cl. ..... 175/56; 175/135

(58) Field of Classification Search ..... 175/55, 175/56, 135
See application file for complete search history.

(56) References Cited

U.S. PATENT DOCUMENTS 3,240,161 A 3/1966 Belau et al.
3,344,873 A * 10/1967 Baittinger ..... 175/55
3,394,766 A 7/1968 Lebelle
3,866,693 A * 2/1975 Century ..... 173/49
4,530,410 A 7/1985 Kay
4,625,811 A 12/1986 Tuenkers
5,058,688 A 10/1991 Scott et al.
5,417,290 A 5/1995 Barrow
5,544,979 A * 8/1996 White ..... 405/232
6,129,159 A 10/2000 Scott et al.
7,357,200 B2 4/2008 Harleman
2005/0022395 A1 2/2005 Hirabayashi
2006/0196751 A1 9/2006 Schneider et al.

OTHER PUBLICATIONS

Geartek Hydraulic Gear Pumps and Motors, 'D' Series Single Pump, Performance Data brochure (undated).

* cited by examiner

*Primary Examiner* — William P Neuder
(74) *Attorney, Agent, or Firm* — Erickson, Kernell, Derusseau & Kleypas, LLC

(57) ABSTRACT

A vibratory unit interposed between a planetary drive and earth-penetrating device, e.g., an auger, is powered by the hydraulic system of a tractor, skid loader or the like. The unit includes a housing having a base plate with a slidable striker plate mounted therein. A Kelly bar displaces the planetary drive from the auger and through the housing. A rotatable shaft with weights eccentrically mounted thereon produces vibratory forces and urges the striker plate into contact with the base plate to provide hammer-like forces on the auger.

15 Claims, 6 Drawing Sheets

VIBRATORY DRILLING APPARATUS

BACKGROUND OF THE INVENTION

This invention relates to drilling equipment and, more particularly, to a vibratory/impulse apparatus for selectable use with an earth-penetrating device, such as an auger, without interference with its normal operation.

The addition of vibratory and impulse actions to an earth-penetrating device, such as a pile driver, auger, hammer or the like, enhances penetration. However, past mechanisms are relatively complex in configuration and require incorporation of the elements with the drilling apparatus. It is therefore desirable to provide an apparatus which is releasably interposed between the drive mechanism and earth-penetrating device so as to provide upon demand a vibratory, hammer-like action during the earth-penetrating action.

SUMMARY OF THE INVENTION

In response thereto I have invented a vibratory drilling apparatus which is releasably interposable between the drive unit of the drilling apparatus, such as a planetary drive, and the earth-penetrating device, such as an auger. The device needs no modifications and is easily attached to the accompanying support vehicle, such as skid loader or tractor. My device generally comprises a housing having a hydraulically controlled vibration/impulse producing mechanism therein. The housing is interposed between the drive unit and the earth penetrator displaced therefrom by an elongated Kelly bar. Operator control of the mechanism, via the hydraulic system commonly found on the support vehicle, produces vibratory and hammer-like forces which are transmitted to the earth-penetrating device.

It is therefore a general object of this invention to provide an apparatus which transmits vibratory and hammer-like forces to an earth-penetrating device, e.g., an auger, to enhance penetration.

Another object of this invention is to provide an apparatus, as aforesaid, which is releasably interposed between the earth-penetrating device and its drive unit.

A still further object of this invention is to provide an apparatus, as aforesaid, which is controlled by the hydraulic system found on support vehicles, e.g., tractors, loaders, skid steer apparatus and the like.

Another object of this invention is to provide an apparatus, as aforesaid, wherein the forces are provided by a hydraulically-controlled shaker plate driven by a shaft having eccentrically mounted weights thereon.

Still a more particular object of this invention is to provide an apparatus, as aforesaid, which allows operator control of the earth-penetrating device independent of the vibratory unit.

A still further object of this invention is to provide an apparatus, as aforesaid, which does not interfere with the function of the drive mechanism.

Another object of this invention is to provide an apparatus, as aforesaid, which does not require internal modification of either the drive mechanism or the earth-penetrating device.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 6:
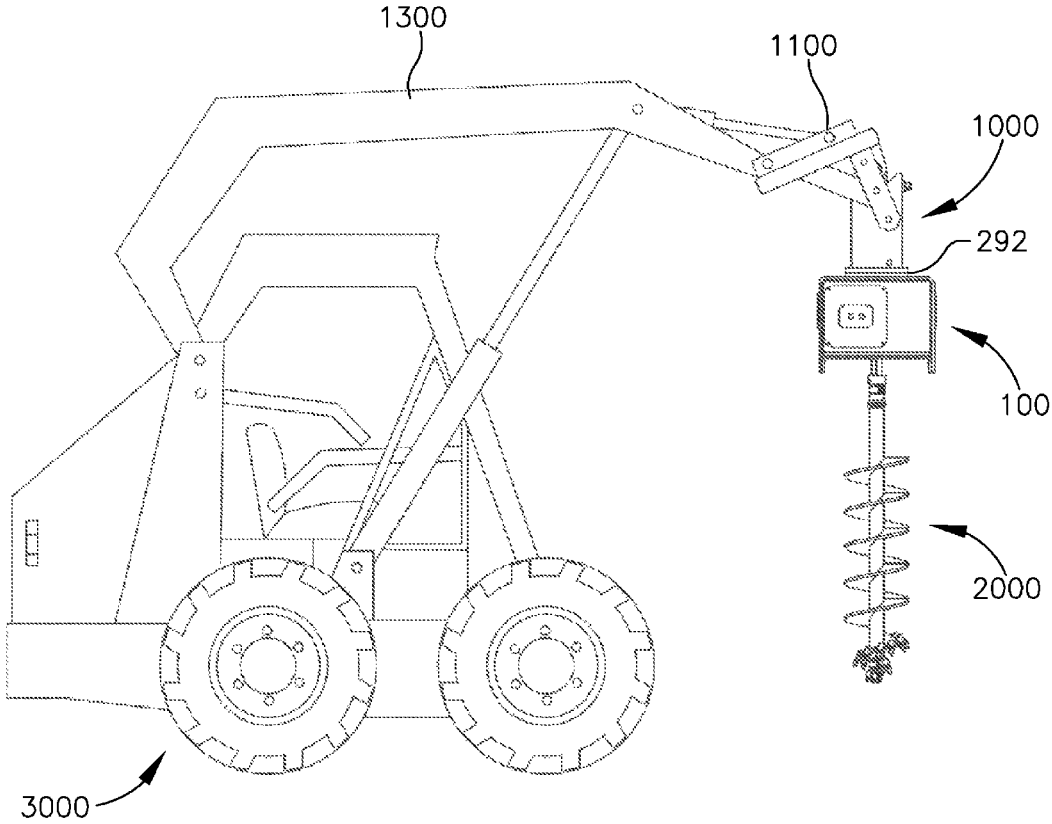
FIG. 6 is a side view showing the apparatus interposed between a planetary mechanism and auger, all being attached to a loader.

Turning more particularly to the drawings, FIG. 6 shows the vibratory drilling apparatus 100 releasably connected between a planetary drive system 1000 and the earth-penetrating device in the form of an auger 2000.

Figure 1:
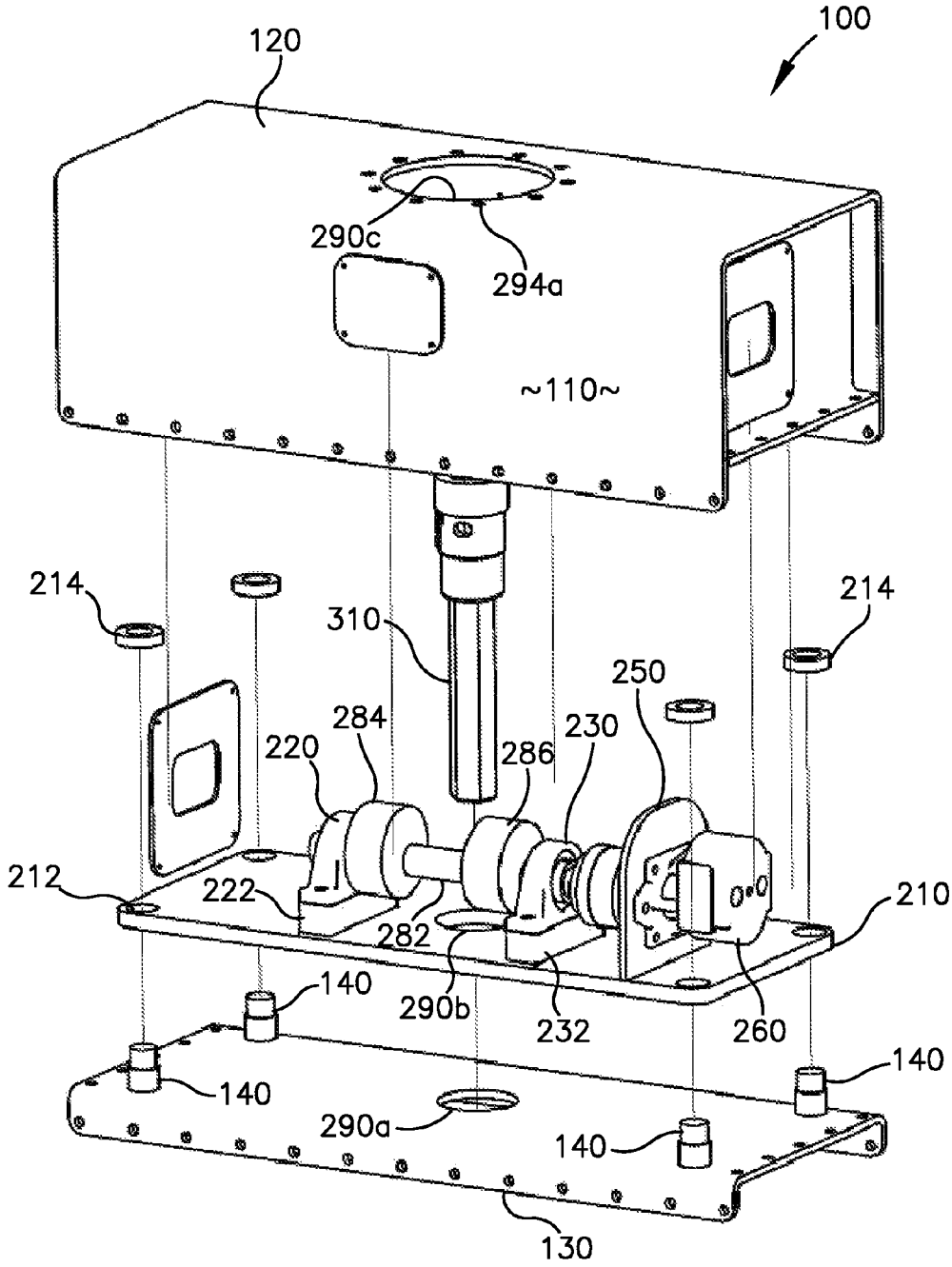
FIG. 1 is an exploded view of the vibratory drilling apparatus.
Figure 2:
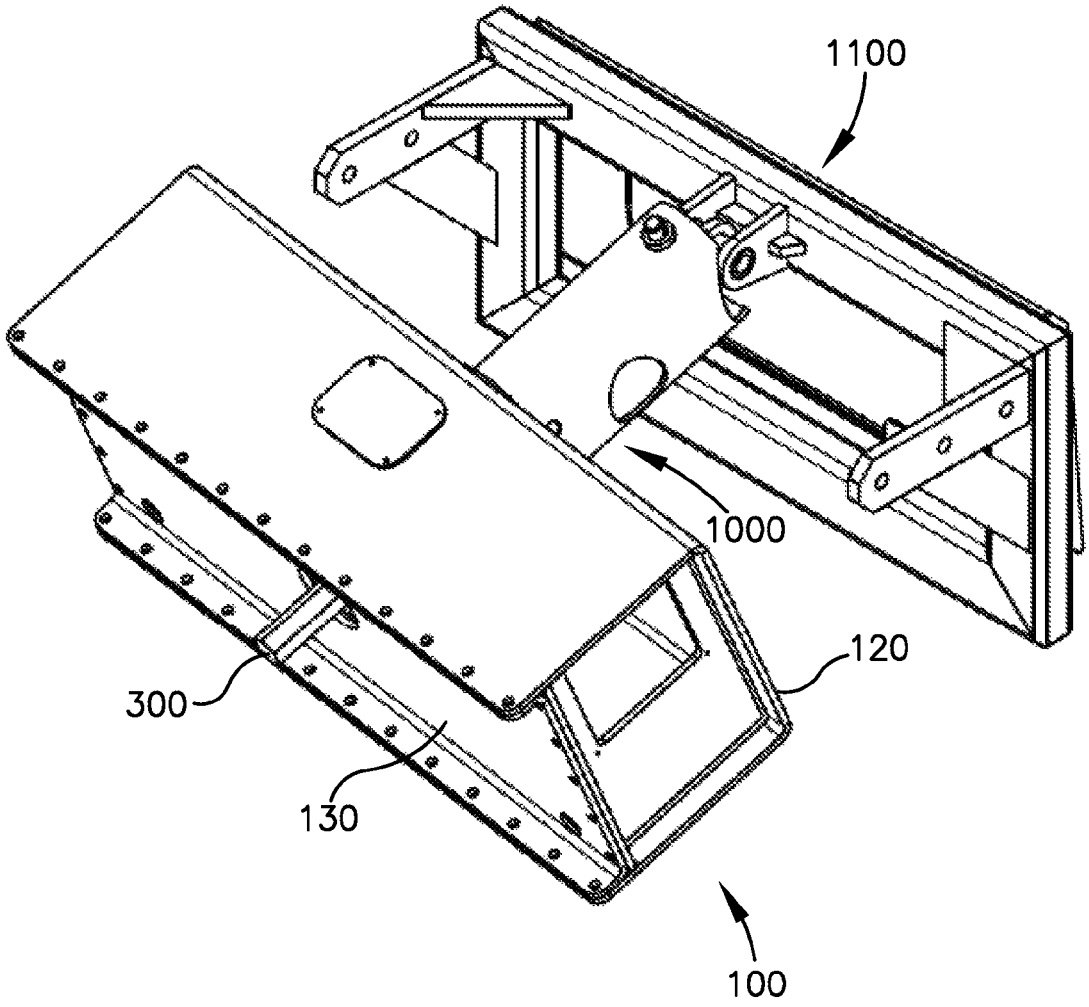
FIG. 2 is a perspective view of the apparatus attached to a planetary drive mechanism extending from its support bracket.
Figure 3:
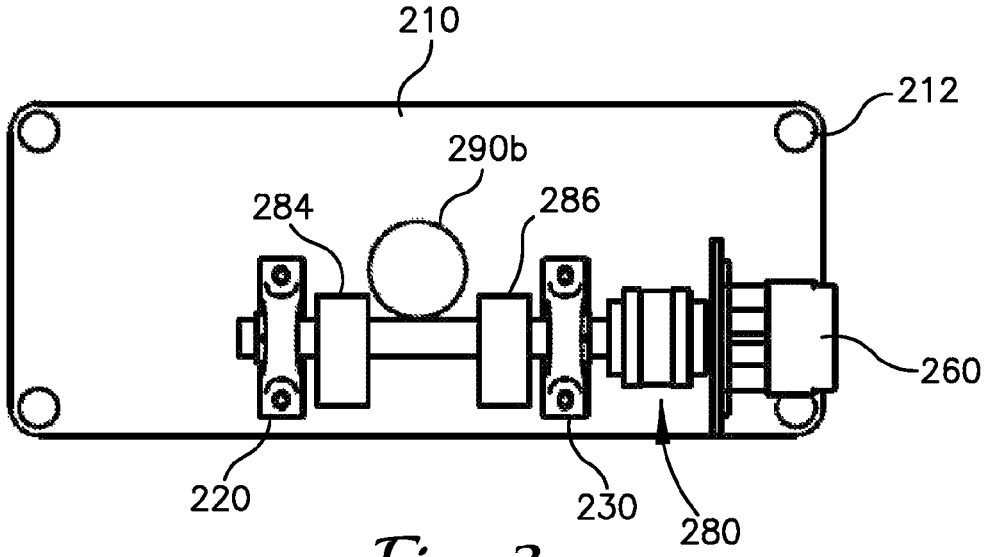
FIG. 3 is a top view of the internal structure of the apparatus on a reduced scale.
Figure 4:
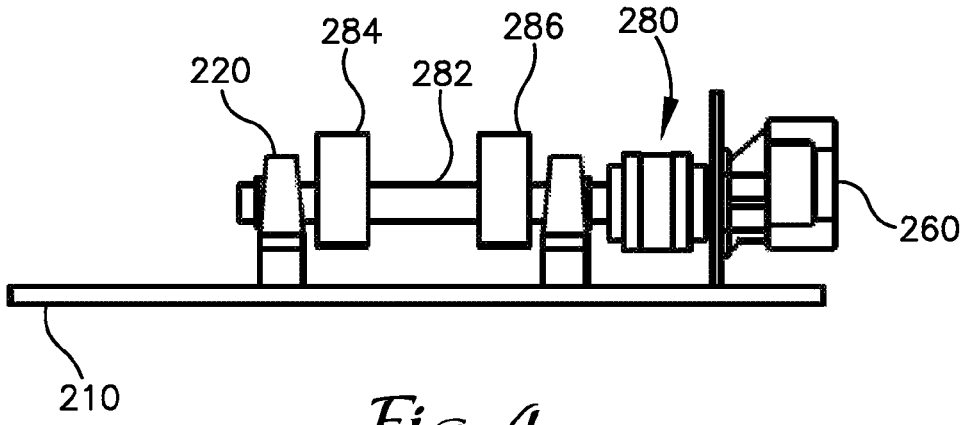
FIG. 4 is a side view of the FIG. 3 apparatus.
Figure 5:
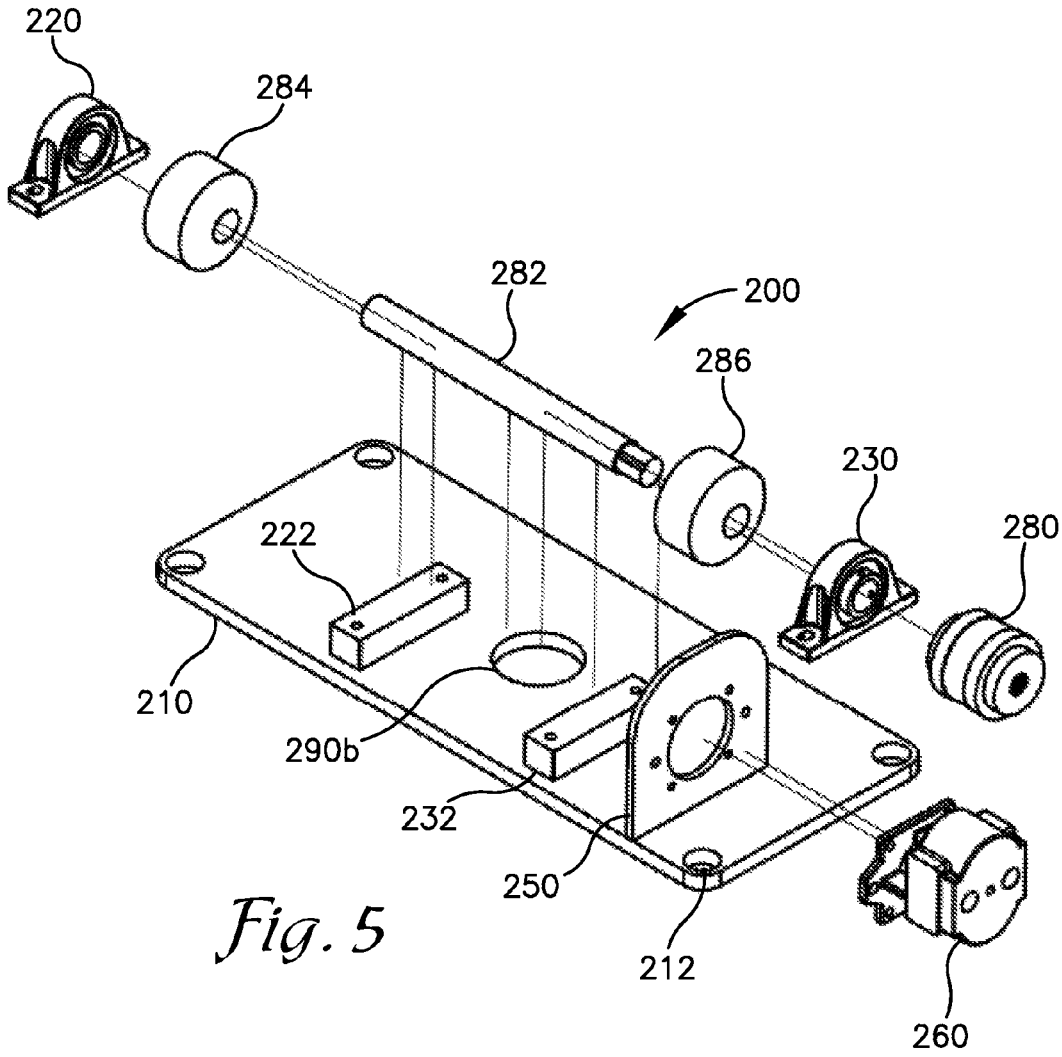
FIG. 5 is an exploded view of the shaker plate assembly of the vibratory/impulse mechanism.

As best shown in FIG. 1, the apparatus 100 comprises a generally rectangular housing 110 including a cover 120 and a base plate 130. Extending from the base plate 130 are guide pins 140 at the four corners of plate 130. A vibration/impulse assembly 200 comprises a mounting or shaker plate 210 having a plurality of apertures 212 allowing for extension of the guide pins 140 therethrough. Rings 214 are welded atop pins 140 to retain plate 210 along pins 140. The length of each pin 140 is greater than the thickness of the plate 210 so as to allow a slidable, reciprocal movement of plate 210 along pins 140 and towards and away the bottom plate 130.

Atop mounting plate 210 are pillow block bearings 220, 230 mounted atop riser blocks 222, 232. Laterally spaced apart from bearings 220, 230 is a motor mounting plate 250 for attachment of a hydraulic motor 260 thereto such as a GearTek hydraulic motor.

A rotatable shaft 282 is coupled to the motor shaft via a Lovejoy coupler 280. Shaft 282 extends between the bearing plates 220, 230 in rotatable support therethrough. A pair of cylindrical weights 284, 286 is mounted off center to shaft 282. This off center mounting presents a cam-like or eccentric relationship between the weights 284, 286 and shaft 282. I now use six-inch diameter weights of approximately 20 pounds mounted one inch off center.

Positioned within the base plate 130, mounting plate 210 and top wall 122 of the cover are aligned apertures 290*a*, 290*b*, 290*c* for extension of a Kelly bar 300 therethrough. One end of the Kelly bar extends beyond cover 120 and is attached to the planetary drive mechanism 1000 in a conventional manner. The other end, which extends beyond base plate 130, is attached to the earth-penetrating device, such as the auger 2000, in a conventional manner, e.g., by a pin coupling or other suitable fastener. The Kelly bar 300 displaces the earth-penetrating auger 200 from the planetary drive mechanism 1000 so as to allow for the vibratory apparatus 100 to be interposed therebetween.

As diagrammatically shown (FIG. 7), hydraulic input 902 and return hoses 904 communicate with the hydraulic reservoir 950 found on the support vehicle 3000 and are part of the hydraulic drive system. These hoses are part of a hydraulic drive system commonly found on the tractor, skid loader or the like so as to drive various attachments. Hose 902 is directed to the planetary drive 1000 and then selector valve 910 so as to provide controlled branches 902*a*, 904*a*. At a first position, valve 910 will direct fluid to motor 260 via branch 902*a* to power the same. Fluid returns to reservoir from motor 260 via line 904*b* as controlled by check valve 906. This return fluid flows through tee 908 for diversion to return line 904. A drain line between motor 260 and reservoir 950 is provided. When valve 910 is at a second position, the fluid is directed through line 904*a*, tee 908 and thus the same return line 904. Motor 260 is thus inactive.

Figure 7:
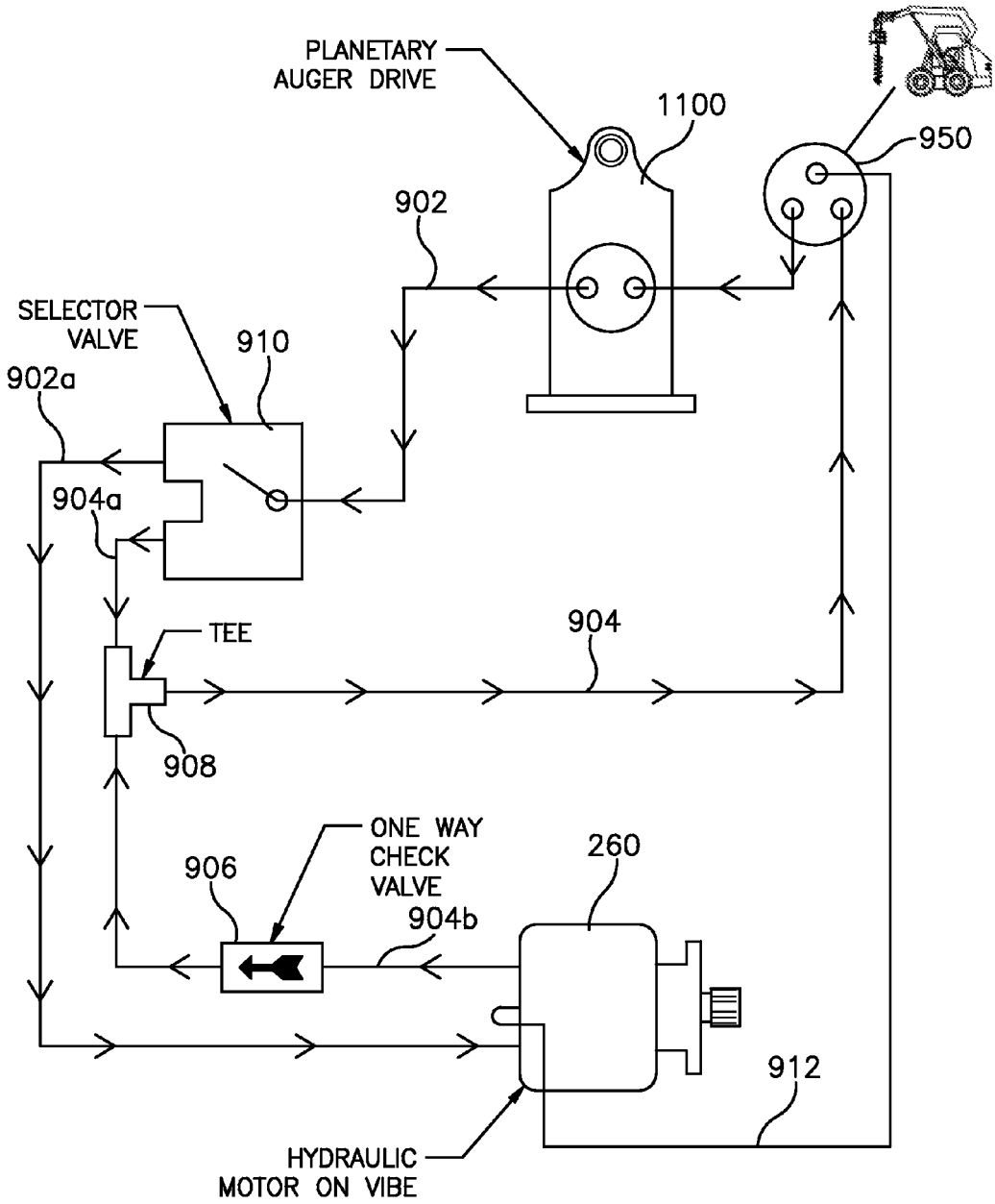
FIG. 7 is a block diagram showing one form of hydraulic flow.

In use, the mounting plate 1100, which supports the planetary drive 1000, is connected to the arms 1300 of the tractor or skid loader. The hydraulic lines are then connected as shown in FIG. 7. A flange 292 surrounding the housing 1010 of the planetary drive mechanism is bolted to the housing cover 120 via apertures in flange 292 and the apertures 294*a* surrounding aperture 290*c*. Auger 200 is placed in its ground contact position and rotated by delivery of hydraulic fluid to the planetary mechanism 1000. When desired the operator operates valve 910 to deliver the hydraulic flow to the motor 260 which rotates the coupled shaft 282. As the weights 284, 286 are eccentrically mounted to the shaft 282, the rotation causes shaking/vibration of plate 210 and movement of plate 210 along pins 140.

It is understood that such eccentric mounting can be accomplished in various manners including mounting a circular weight off center, mounting variously configured weights at a position displaced from their center of mass or using cam-like configurations. The goal is to provide a mounting of the weight to the shaft 282 so as to provide vibratory and impulse forces during rotation of shaft 282. The plate 210 movement includes slidable movement along pins 140 and towards base plate 130 for contact/striking therewith. This plate contact, due to the plate mass, produces significant hammer-like forces which are transmitted to the auger 2000 via the Kelly bar 300. The combination of vibratory and impulse forces are primarily directed to the auger 2000 as forces in the opposed direction are resisted by downward forces acting on the assembly 100, such as by the weight of the planetary drive assembly 1000 and the downward forces being exited by the hydraulically-controlled mounting arms 1300 of the tractor, skid steerer or the like. Thus, vibratory and/or impulse forces, as directed to the rotating auger 2000, enhance its earth-penetrating action.

Accordingly, it can be seen that the vibratory drilling apparatus 100 is easily interposed between the drive assembly and earth-penetration apparatus without need for their modification. Significant vibratory and hammer-like forces are ultimately delivered to the auger 2000 upon demand as the unit 100 can be selectively energized without interference with operation of the earth-penetration device.

It is to be understood that while certain forms of this invention have been illustrated and described, it is not limited thereto, except in so far as such limitations are included in the following claims.

Having thus described the invention, what is claimed as new and desired to be secured by Letters Patent is:

1. A vibratory unit for an earth-penetrating device powered by a drive system, said unit comprising:
- a housing including a base plate;
- a mounting plate within said housing;
- means for slidably moving said mounting plate towards and away from said base plate;
- a rotatable shaft on said mounting plate;
- at least one weight eccentrically mounted about said shaft;
- a motor;
- means for associating said motor with said mounting plate;
- means for coupling said motor to said shaft;
- means for powering said motor whereby to rotate said shaft;
- an extension bar extending through said housing and presenting a first end beyond said housing and a second end beyond said base plate;
- means for coupling said first end of said bar to the drive system;
- means for coupling the second end of said bar to the earth-penetrating device, said housing interposed between the drive system and earth-penetrating device with said extension bar passing therethrough, a powering of the drive system transmitted to the earth-penetrating device coupled thereto by said bar;
- a powering of said motor rotating said shaft and said at least one weight thereon producing vibratory forces and forces for urging said mounting plate into said slidable movement for contact with said base plate, said contact providing an impulse force on the earth-penetrating device whereby said forces enhance penetration.

2. The unit as claimed in claim 1 wherein the earth-penetrating device comprises an auger, the drive system rotating said auger.

3. The unit as claimed in claim 1 wherein said means for slidably moving said mounting plate comprises:
- a plurality of guide pins extending from said base plate;
- a plurality of apertures in said mounting plate, each guide pin extending through a respective aperture, said mounting plate slidable along said guide pins;
- means on said guide pins for precluding movement of said mounting plate beyond said guide pins in a first direction, a movement of said mounting plate in a second opposed direction resulting in said contact of said mounting plate with said base plate.

4. The unit as claimed in claim 1 wherein the drive system comprises a hydraulic system, said motor and earth-penetrating device being powered by a hydraulic fluid flow provided by said system.

5. A vibratory unit for use with an earth-penetrating device and a drive system for operating the device, said unit comprising:
- a base plate;
- a striker plate;
- means for slidably mounting said striker plate towards and away from said base plate;
- a rotatable shaft on said striker plate;
- at least one weight eccentrically positioned on said shaft;
- a motor for rotating said shaft;
- an extension bar extending through said base plate and striker plate and presenting a first end beyond said striker plate and a second end beyond said base plate, said striker plate movable along said extension bar;
- means for coupling said first end of said bar to the drive system;
- means for coupling the second end of said bar to the earth-penetrating device, a powering of the drive system operating the earth-penetrating device coupled thereto by means of said extension bar;
- a powering of said motor rotating said shaft and said at least one weight thereon, said shaft rotation providing vibratory forces and urging said striker plate into said slidable movement for contact with said base plate, said contact providing an impulse force on the earth-penetrating device whereby to enhance its penetration.

6. The unit as claimed in claim 5 wherein the earth-penetrating device comprises an auger, the drive system rotating the auger.

7. The unit as claimed in claim 5 wherein said slidable mounting means comprises:
- a plurality of guide pins extending from said base plate;

a plurality of apertures in said striker plate, each guide pin extending through a respective aperture, said striker plate slidable along said guide pins;

means on said guide pins for precluding movement of said striker plate beyond said guide pins in a first direction, a movement of said striker plate in a second opposed direction resulting in said contact of said striker plate with said base plate.

8. The unit as claimed in claim 5 further comprising a housing for enclosing said striker plate, said base plate providing one side of said housing, said extension bar presenting a first end beyond said housing and a second end beyond said base plate.

9. The unit as claimed in claim 5 wherein the drive system comprises a hydraulic system, said motor and earth-penetrating device being powered by a hydraulic fluid flow provided by said system.

10. A vibratory unit for use with an auger and a drive system for rotating the auger, said unit comprising:

a housing including a base plate;

a mounting plate;

means for guiding said mounting plate in movement towards and away from said base plate;

a rotatable shaft on said mounting plate;

at least one weight eccentrically mounted to said shaft relative to a central axis passing through said shaft;

a motor, said motor rotating said shaft upon operation of said motor;

an extension bar extending through said housing and presenting a first end and a second end;

means for coupling said first end of said bar to the drive system;

means for coupling the second end of said bar to the auger, a powering of the drive system rotating the bar and the auger coupled thereto;

a powering of said motor rotating said shaft with said at least one weight thereon, said rotation producing forces for urging the mounting plate in said movement towards and away from said base plate, a movement of said mounting plate towards said base plate providing impulse forces for delivery to the auger, whereby to enhance an earth penetration of the auger.

11. The unit as claimed in claim 10 wherein said means for guiding said mounting plate comprises:

a plurality of guide pins extending from said base plate;

a plurality of apertures in said mounting plate, each guide pin extending through a respective aperture, said mounting plate slidable along said guide pins;

means on said guide pins for precluding movement of said mounting plate beyond said guide pins in a first direction, a movement of said mounting plate in a second opposed direction resulting in said contact of said mounting plate with said base plate.

12. The unit as claimed in claim 10 wherein said mounting plate contacts said base plate during a portion of said movement, said contact providing said impulse forces to said auger to enhance said auger penetration.

13. The unit as claimed in claim 10 wherein said at least one weight is generally circular in configuration, said at least one weight having a center point, said shaft extending through said at least one weight at a position offset from the center point thereof to provide said eccentric mounting.

14. The unit as claimed in claim 10 further comprising means for powering said motor independent of said power of the drive system.

15. The unit as claimed in claim 13 wherein said at least one weight comprises at least two weights generally circular in configuration, said shaft extending through said at least two weights at a position offset from the center points thereof.

* * * * *